US010224154B2

(12) United States Patent
Long et al.

(10) Patent No.: US 10,224,154 B2
(45) Date of Patent: Mar. 5, 2019

(54) MAGNETIC PROXIMITY SWITCH

(71) Applicant: CHUANDONG MAGNETIC ELECTRONIC CO., LTD., Foshan, Guangdong (CN)

(72) Inventors: Kewen Long, Foshan (CN); Tianbao Yan, Foshan (CN)

(73) Assignee: CHUANDONG MAGNETIC ELECTRONIC CO., LTD (CN)

( * ) Notice: Subject to any disclaimer, the term of this patent is extended or adjusted under 35 U.S.C. 154(b) by 0 days.

(21) Appl. No.: 15/303,001

(22) PCT Filed: Oct. 13, 2014

(86) PCT No.: PCT/CN2014/088449

§ 371 (c)(1),
(2) Date: Oct. 9, 2016

(87) PCT Pub. No.: WO2015/196630

PCT Pub. Date: Dec. 30, 2015

(65) Prior Publication Data

US 2017/0032901 A1 Feb. 2, 2017

(30) Foreign Application Priority Data

Jun. 27, 2014 (CN) ..... 2014 1 0299835

(51) Int. Cl.
*H01H 9/26* (2006.01)
*H01H 13/76* (2006.01)
(Continued)

(52) U.S. Cl.
CPC ..... *H01H 5/18* (2013.01); *H01H 5/22* (2013.01); *H01H 33/04* (2013.01); *H01H 36/00* (2013.01); *H01H 36/0006* (2013.01)

(58) Field of Classification Search
CPC ..... G05B 15/02; G05B 2219/25439; G05B 2219/2642; H03K 17/962; H01H 5/02;
(Continued)

(56) References Cited

U.S. PATENT DOCUMENTS 3,449,700 A * 6/1969 Gillilan ..... H01H 5/02 335/188
7,232,971 B2 * 6/2007 Chen ..... H01H 23/20 200/308
7,453,049 B2 * 11/2008 Ochiai ..... H01H 5/18 200/449

FOREIGN PATENT DOCUMENTS

CN 2134711 Y 5/1993
CN 1286798 A 3/2001
(Continued)

*Primary Examiner* — Anthony R. Jimenez

(57) ABSTRACT

This invention relates to a new magnetic proximity switch, comprising a shell, wherein a moving magnet that can move up and down is disposed on the upper part in the shell; a first terminal strip and a second terminal strip are fixedly disposed left and right in parallel at the bottom in the shell; a static contact is disposed on the second terminal strip; an elastic piece is disposed on the first terminal strip; a moving contact is disposed at the outer end of the elastic piece; an assistant rod is disposed at the middle part in the shell, an assistant portion is disposed at the inner end of the assistant rod, a limiting mechanism is disposed between the assistant rod and the shell, an elastic tongue piece is disposed on the elastic piece, and the outer end of the elastic tongue piece is disposed against the assistant portion.

19 Claims, 3 Drawing Sheets

(51) Int. Cl.

| | |
|---|---|
| ***H01H 13/72*** | (2006.01) |
| ***H01H 5/18*** | (2006.01) |
| ***H01H 36/00*** | (2006.01) |
| ***H01H 33/04*** | (2006.01) |
| ***H01H 5/22*** | (2006.01) |

(58) Field of Classification Search

CPC ..... H01H 5/18; H01H 33/04; H01H 36/00; H01H 36/0006; H01H 1/00; H01H 1/12; H01H 1/2025; H01H 1/22; H01H 3/00; H01H 3/02; H01H 3/04; H01H 3/12; H01H 13/00; H01H 13/20; H01H 13/26; H01H 13/28; H01H 13/36; H01H 13/50; H01H 13/52; H01H 2003/00; H01H 13/008; H01H 13/02; H01H 5/22; H01H 36/0033; H01H 36/004; H01H 36/0046; H01H 36/0073

USPC ..... 200/404, 449, 5 A; 335/207, 188

See application file for complete search history.

(56) References Cited

FOREIGN PATENT DOCUMENTS

| | | | |
|---|---|---|---|
| CN | 201584363 | U | 9/2010 |
| CN | 104037016 | A | 10/2014 |
| CN | 203950738 | U | 11/2014 |
| JP | 2011034771 | A | 2/2011 |

* cited by examiner

MAGNETIC PROXIMITY SWITCH

TECHNICAL FIELD OF THE INVENTION

The present invention relates to the technical field of a proximity switch, and more particularly, to a new magnetic proximity switch.

BACKGROUND OF THE INVENTION

The magnetic proximity switch is a device capable of realizing the switching-on and switching-off functions through the interaction of the moving magnet, the static magnet and the external magnet, which are currently being widely used in many technical fields. The reasonableness of its structure can directly determine the quality and lifespan of the new magnetic proximity switch.

In the prior art, the reset mechanism of the magnetic proximity switch is comprised of the tension spring components, which have the following disadvantages: firstly, after being in use for a long time, the elastic force can be reduced due to metal fatigue, resulting in a slow springing back motion, a reduced acting force and frequent arcing. Second, the installation of the tension spring components requires more assistant parts, making the device's structure more complicated, having a difficult assembly and high manufacturing cost. Third, in order to realize both switching-on and switching-off states, the tension spring may bear a relatively large stress in a normally-open state due to the long working distance, leading to the metal fatigue and decrease of the product's lifespan.

In conclusion, the shortcomings of the traditional magnetic proximity switch are urgent problems that need to be solved for those skilled in this field.

SUMMARY OF THE INVENTION

The purpose of the present invention is to overcome the shortcomings of the prior art and provide a new magnetic proximity switch, strengthening the instantaneous acting force when the contact point is open or closed. Additionally, the present invention has a smaller movement angle, which can effectively relieve the metal fatigue and solve the arcing problem caused by long-term use that frequently occurs in the prior art.

To achieve the above purpose, the present invention adopts the following technical solution:

A new magnetic proximity switch, comprising a shell, wherein a moving magnet that can move up and down is disposed on the upper part in the shell. A first terminal strip and a second terminal strip are fixedly provided left and right in parallel at the bottom in the shell; and, a static contact is disposed on the upper end of the second terminal strip. An elastic piece is disposed on the first terminal strip, and a moving contact is disposed at the outer end of the elastic piece. The moving contact and the static contact are provided correspondingly; an assistant rod is disposed at the middle part in the shell, and the assistant rod is swingably disposed in the shell. An assistant portion is disposed at the inner end of the assistant rod. A limiting mechanism is disposed between the assistant rod and the shell. The moving magnet and the assistant portion are provided correspondingly, and an elastic tongue piece is disposed on the elastic piece, and the outer end of the elastic tongue piece is disposed against the assistant portion.

In another aspect of the present invention, a pivot point is disposed on the assistant rod, through which the assistant rod can swing in the shell.

In another aspect of the present invention, a locking portion is disposed at the outer end of the assistant rod, and a limiting groove is disposed on the inner wall of the shell. The limiting mechanism comprises a locking portion and a limiting groove. The locking portion is disposed in the limiting groove.

In another aspect of the present invention, a locking groove is disposed at the outer side of the assistant portion. The outer end of the elastic tongue piece is disposed in the inside of the locking groove.

In another aspect of the present invention, a fixed groove is disposed on the upper end of the first terminal strip. The inner end of the elastic piece is locked in the fixed groove. The inner end of the elastic tongue piece is fixedly connected to that of the elastic piece.

In another aspect of the present invention, the position of the pivot point is higher than that of the fixed groove.

In another aspect of the present invention, the pivot point is disposed at the middle of the assistant rod. When the height of the limiting groove is defined as "H", the height of the locking portion is defined as "h" and the horizontal distance from the fixed groove to the locking groove is defined as "L", the calculation formula of "H", "h" and "L" is $L/(H-h)=10-12$.

In another aspect of the present invention, the elastic tongue piece and the elastic piece are molded in one body.

In another aspect of the present invention, the elastic tongue piece is made of beryllium bronze.

In the present invention, the moving magnet moves downwards under the action of the external magnet so as to press the elastic tongue piece through the assistant portion until the moving contact and the static contact are closed. After eliminating the acting force of the external magnet, the moving contact and the static contact can recover under the action of the elastic tongue piece. Compared with the prior art, the present invention has the following advantages: firstly, the present invention has a limiting mechanism, which can effectively confine the assistant portion's upward and downward action, avoiding the metal fatigue caused by an excessive moving range of the elastic tongue piece and solving the arcing problem produced by long-term use. Second, the cooperation of the elastic piece and the elastic tongue piece of the present invention significantly simplifies the internal structure, simplifying the device's assembly and reducing the manufacturing cost. Additionally, the reasonable design of the structure also prolongs the product's lifespan and greatly extends the application fields of the present invention.

BRIEF DESCRIPTION OF THE DRAWINGS

To clearly expound the present invention or the technical solution, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

1, Shell; 11、 Sliding Groove; 12、 Limiting Groove;
2, Moving Magnet;
3, Assistant Rod; 31、 Pivot Point; 32、 Locking Portion; 33、 Assistant Portion; 331、 Locking Groove;
4、 Elastic Piece; 41、 Moving Contact;
5、 Elastic Tongue Piece;
6、 The First Terminal Strip; 61、 Fixed Groove;
7、 The Second Terminal Strip; 71、 Static Contact.

DETAILED DESCRIPTION OF THE INVENTION

Drawings and detailed embodiments are combined hereinafter to elaborate the technical principles of the present invention.

Figure 1:
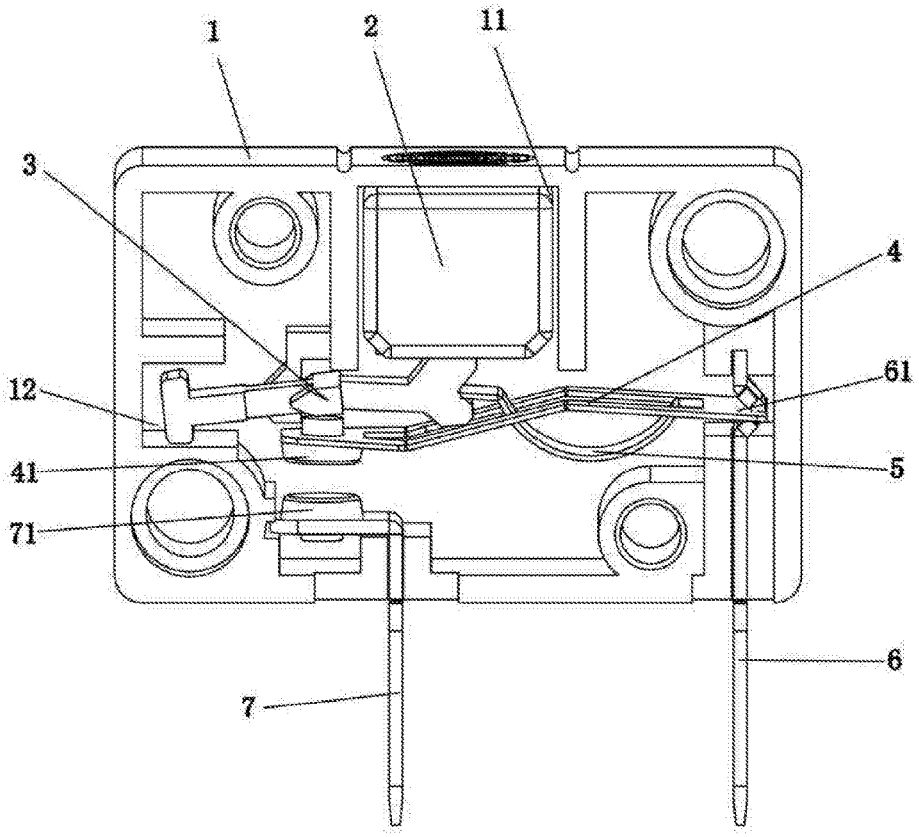
FIG. 1 is an overall structure diagram of the present invention in a switched-off state.
Figure 2:
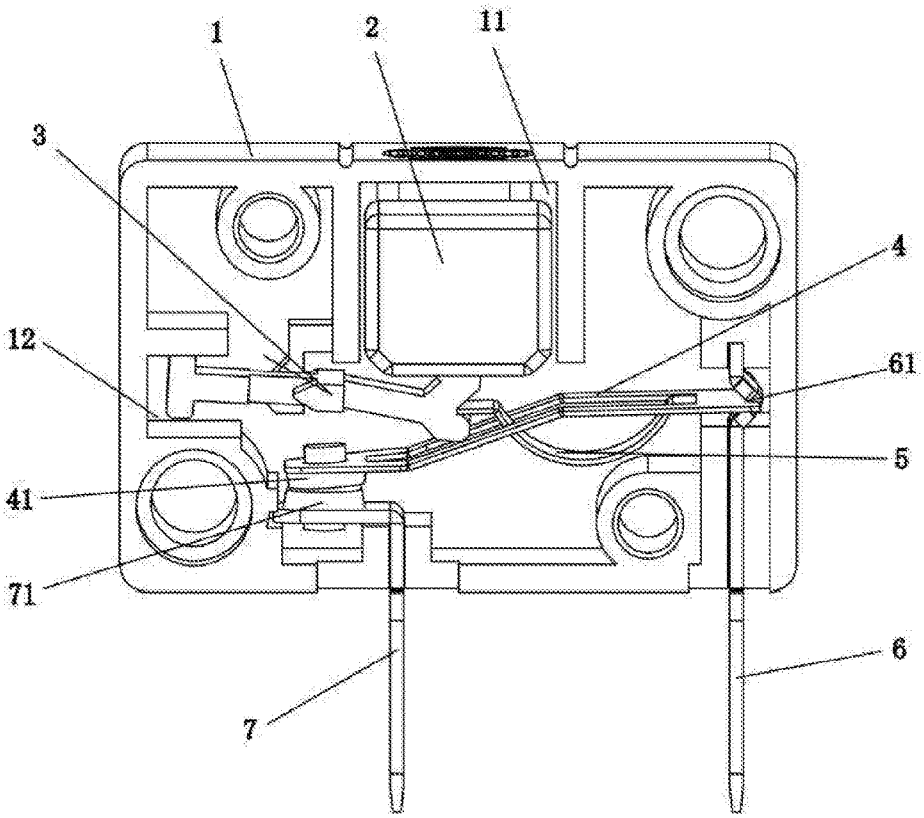
FIG. 2 is an overall structure diagram of the present invention in a switched-on state.
Figure 3:
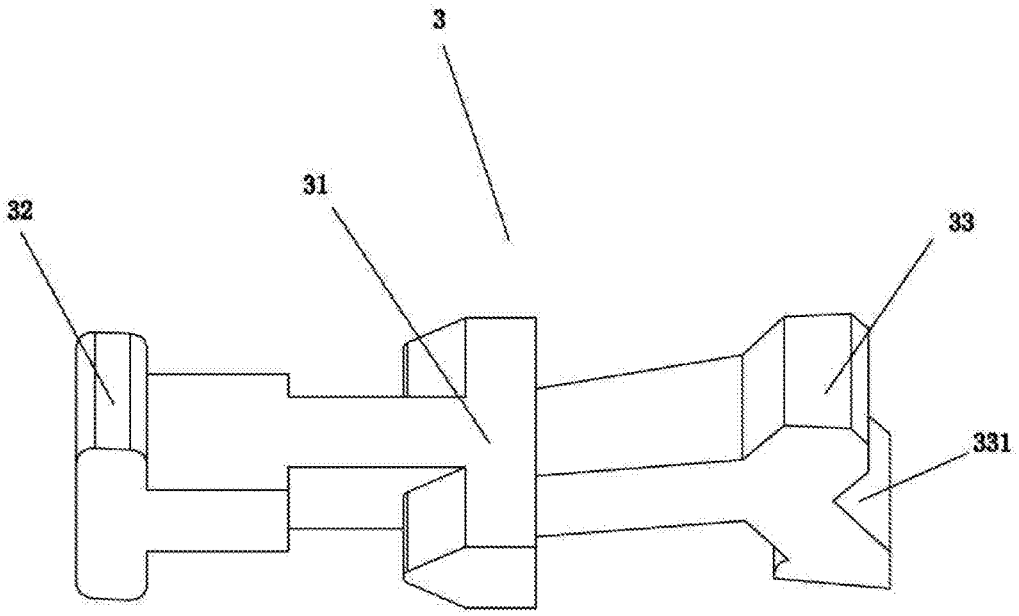
FIG. 3 is a structure diagram of the assistant rod of the present invention.

As shown in FIGS. 1-3, the new magnetic proximity switch of the present invention comprises a shell 1, wherein a moving magnet 2, which can move up and down, is disposed on the upper part in the shell 1. Specifically, a sliding groove 11 is disposed in the shell 1, and the moving magnet 2, which can move up and down, is disposed in the sliding groove 11. A sliding track is disposed in the sliding groove 11, and the moving magnet 2 is disposed on the sliding track, enabling the moving magnet 2 to move up and down more stably. The way in which the moving magnet 2 is disposed in the shell 1 is similar to the prior art, which is illustrated briefly herein.

A first terminal strip 6 and a second terminal strip 7 are fixedly provided left and right in parallel at the bottom in the shell 1. A static contact 71 is disposed on the upper end of the second terminal strip 7.

An elastic piece 4 is disposed on the first terminal strip 6. Preferably, a fixed groove 61 is disposed on the upper end of the first terminal strip 6 of the present invention, and the inner end of the elastic piece 4 is locked in the fixed groove 61. The fixed groove 61 is ">" shaped, and the inner end of the elastic piece 4 is disposed against the fixed groove 61. Such structure can be assembled quickly and easily. Certainly, the present invention can also be realized through other similar structures. For instance, the inner end of the elastic piece 4 can be directly fixed to the upper end of the first terminal strip 6.

A moving contact 41 is disposed at the outer end of the elastic piece 4. The moving contact 41 and the static contact 71 are provided correspondingly. The present invention can switched on and off through the contact and separation of the moving contact 41 and the static contact 71.

An assistant rod 3 is swingably provided in the shell 1. Specifically, a pivot point 31 is disposed on the assistant rod 3, through which the assistant rod 3 can swing in the shell 1. An assistant portion 33 is disposed at the inner end of the assistant rod 3. The assistant portion 33 and the moving magnet 2 are provided correspondingly.

An elastic tongue piece 5 is disposed on the elastic piece 4. The inner end of the elastic tongue piece 5 is fixed to the elastic piece 4. Preferably, the elastic tongue piece 5 and the elastic piece 4 of the present invention are molded in one body. The outer end of the elastic tongue piece 5 is disposed against the assistant rod 33 so as to provide a more stable connection between the elastic tongue piece 5 and the assistant portion 33. A locking groove 331 is disposed at the outer side of the assistant portion 33. The locking groove 331 is "<" shaped so that the outer end of the elastic tongue piece 5 can be provided only against the locking groove 331, making the device's assembly quick and easy. Additionally, the elastic tongue piece 5 is made of beryllium bronze, which can effectively improve the elastic force of the elastic tongue piece 5.

A limiting mechanism is disposed between the assistant rod 3 and the shell 1. Specifically, a locking portion 32 is disposed at the outer end of the assistant rod 3, and a limiting groove 12 is disposed on the inner wall of the shell 1. The limiting mechanism consists of the locking portion 32 and the limiting groove 12. The locking portion 32 is disposed in the limiting groove 12.

As shown in FIG. 1, in the initial state of the present invention during operation, the moving contact 41 and the static contact 71 are separated; namely, the present invention is in a switching-off state (normally-open state). At the moment, the elastic tongue piece 5 moves up to support the moving magnet 2 through the assistant portion 33. The moving magnet 2 is placed at the upper part in the sliding groove 11, and the lower end of the locking portion 32 is disposed against the lower edge of the limiting groove 12. When the present invention is switch-ed, the external magnet can move close to the upper part of the shell 1, driving the moving magnet 2 to move downwards. When the moving magnet 2 moves downwards, the assistant portion 33 is pressed to swing down around the pivot point 31. Meanwhile, the locking portion 32 swings up around the pivot point 31 until the upper end of the locking portion 32 is against the upper edge of the limiting groove 12, and the assistant portion 33 drives the elastic piece 4 and the moving contact 41 to move down through the elastic tongue piece 5 until the moving contact 41 and the static contact 71 are closed tightly. Consequently, the present invention can be switched on. The elastic tongue piece 5 always stays in a pressed state, ultimately keeping an upward restoring force. When the present device is switched off, the external magnet can be removed, enabling the assistant portion 33 to press the moving magnet 2 to move up under the action of the upward acting force of the elastic tongue piece 5. Thus, the present invention can be switched off (as shown in FIG. 2). The limiting mechanism of the present invention can excellently limit the upward and downward movement of the assistant portion 33.

In a preferred embodiment of the present invention, the position of the pivot point 31 is slightly higher than that of the fixed groove 61. When the present invention is switched off, the elastic tongue piece 5 can conveniently support the assistant portion 33, and the elastic tongue piece 5 can bear a smaller bending force, which greatly reduces the metal fatigue of the elastic tongue piece 5 and prolongs the lifespan of the present invention.

In particular, to illustrate another innovation of the present invention, the pivot point 31 is disposed at the middle of the assistant rod 3. Namely, the distance between the assistant portion 33 and the pivot point 31 is equal to that between the locking portion 32 and the pivot point 31 so that the upward and downward swing of the assistant portion 33 can be easily controlled through the cooperation of the locking portion 32 and the limiting groove 12. Consequently, the acting force borne by the elastic tongue piece 5 can be kept in a reasonable range, reducing the metal fatigue and keeping an ideal restoring force. Specifically, when the height of the limiting groove 12 is defined as "H" (the distance between the upper edge and the lower edge of the limiting groove 12), the height of the locking portion 32 is defined as "h" (the distance between the upper end and the lower end of the locking portion 32) and the horizontal distance from the fixed groove 61 to the locking groove 331 is defined as "L", the calculation formula of "H", "h" and "L" is L/(H−h)=10−12. When the value of L/(H−h) is higher than 12, the testing results show that the displacement of the assistant portion 33 is too small as the present invention is transferred from a switching-on to a switching off state, which leads to a smaller bending degree and restoring force of the elastic tongue piece 5. Additionally, the arcing problem may easily occur due to the low speed of breaking-off. However, when the value of L/(H−h) is lower than 10, the bending degree of the elastic tongue piece 5 becomes higher, resulting in metal fatigue of the elastic tongue piece 5 and sharply shortening the lifespan of the present invention.

Moreover, compared with the prior art, the present invention greatly simplifies the internal structure and reduces the manufacturing cost.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A magnetic proximity switch, comprising a shell, wherein a moving magnet that can move up and down is disposed on an upper part in the shell; wherein a first terminal strip and a second terminal strip are fixedly provided left and right in parallel at a bottom part in the shell, wherein a static contact is disposed on the second terminal strip, wherein an elastic piece is disposed on the first terminal strip, wherein a moving contact is disposed at an outer end of the elastic piece, wherein the moving contact and the static contact are provided adjacent one another, wherein an assistant rod is disposed at a middle part in the shell, and the assistant rod is swingably disposed in the shell, wherein an assistant portion is disposed at an inner end of the assistant rod, wherein a limiting mechanism is disposed between the assistant rod and the shell, wherein the moving magnet and the assistant portion are provided adjacent one another, wherein an elastic tongue piece is disposed on the elastic piece, and an outer end of the elastic tongue piece is disposed against the assistant portion.

2. The magnetic proximity switch of claim 1, wherein a pivot point is disposed on the assistant rod, enabling the assistant rod to swing in the shell.

3. The magnetic proximity switch of claim 2, wherein a locking portion is disposed at an outer end of the assistant rod, and a limiting groove is disposed on an inner wall of the shell, wherein the limiting mechanism is comprised of the locking portion and the limiting groove, wherein the locking portion is disposed in the limiting groove.

4. The magnetic proximity switch of claim 3, wherein a locking groove is disposed at an outer side of the assistant portion, wherein the outer end of the elastic tongue piece is interiorly provided against the locking groove.

5. The magnetic proximity switch of claim 2, wherein a fixed groove is disposed on an upper end of the first terminal strip, wherein an inner end of the elastic piece is locked in the fixed groove, wherein an inner end of the elastic tongue piece is fixedly connected to that of the elastic piece.

6. The magnetic proximity switch of claim 5, wherein a position of the pivot point is higher than that of the fixed groove.

7. The magnetic proximity switch of claim 6, wherein the pivot point is disposed at a middle part of the assistant rod, wherein when a height of the limiting groove is defined as "H", a height of the locking portion is defined as "h" and a horizontal distance from the fixed groove to the locking groove is defined as "L", wherein a unit of measurement for "H', "h", and "L" are the same, and "L/(H−h)" is equal to a ratio of 10 to 12.

8. The magnetic proximity switch of claim 7, wherein the elastic tongue piece and the elastic piece are molded in one body.

9. The magnetic proximity switch of claim 7, wherein the elastic tongue piece is made of beryllium bronze.

10. The magnetic proximity switch of claim 3, wherein a fixed groove is disposed on an upper end of the first terminal strip, wherein an inner end of the elastic piece is locked in the fixed groove, wherein an inner end of the elastic tongue piece is fixedly connected to that of the elastic piece.

11. The magnetic proximity switch of claim 10, wherein the position of the pivot point is higher than that of the fixed groove.

12. The magnetic proximity switch of claim 11, wherein the pivot point is disposed at a middle part of the assistant rod, wherein when a height of the limiting groove is defined as "H", a height of the locking portion is defined as "h" and a horizontal distance from the fixed groove to the locking groove is defined as "L", wherein a unit of measurement for "H', "h", and "L" are the same, and "L/(H−h)" is equal to a ratio of 10 to 12.

13. The magnetic proximity switch of claim 12, wherein the elastic tongue piece and the elastic piece are molded in one body.

14. The magnetic proximity switch of claim 12, wherein the elastic tongue piece is made of beryllium bronze.

15. The magnetic proximity switch of claim 1, wherein a fixed groove is disposed on an upper end of the first terminal strip, wherein an inner end of the elastic piece is locked in the fixed groove, wherein an inner end of the elastic tongue piece is fixedly connected to that of the elastic piece.

16. The magnetic proximity switch of claim 15, wherein a position of the pivot point is higher than that of the fixed groove.

17. The magnetic proximity switch of claim 16, wherein the pivot point is disposed at a middle part of the assistant rod, wherein when a height of the limiting groove is defined as "H", a height of the locking portion is defined as "h" and a horizontal distance from the fixed groove to the locking groove is defined as "L", wherein a unit of measurement for "H', "h", and "L" are the same, and "L/(H−h)" is equal to a ratio of 10 to 12.

18. The magnetic proximity switch of claim 17, wherein the elastic tongue piece and the elastic piece are molded in one body.

19. The magnetic proximity switch of claim 17, wherein the elastic tongue piece is made of beryllium bronze.

* * * * *